US005795146A

United States Patent [19]

Orbeck

[11] Patent Number: 5,795,146

[45] Date of Patent: Aug. 18, 1998

[54] FURNACE CHAMBER HAVING EDUCTOR TO ENHANCE THERMAL PROCESSING

[75] Inventor: Gary A. Orbeck, Windham, N.H.

[73] Assignee: BTU International, Inc., North Billerica, Mass.

[21] Appl. No.: 653,709

[22] Filed: May 23, 1996

[51] Int. Cl.[6] ..... F27B 3/22

[52] U.S. Cl. ..... 432/176; 432/199

[58] Field of Search ..... 432/121, 152, 432/153, 176, 189, 199

[56] References Cited

U.S. PATENT DOCUMENTS

| | | | |
|---|---|---|---|
| Re. 29,622 | 5/1978 | Lange | 65/27 |
| 1,717,115 | 6/1929 | McCann | 432/176 |
| 2,504,320 | 4/1950 | Gamble | 432/176 |
| 3,426,734 | 2/1969 | Richard et al. | 122/478 |
| 3,875,875 | 4/1975 | Stenlund | 110/28 F |
| 3,998,615 | 12/1976 | Gartz, Jr. et al. | 65/29 |
| 4,055,334 | 10/1977 | Stephens | 266/138 |
| 4,059,399 | 11/1977 | Cellier et al. | 432/121 |
| 4,060,379 | 11/1977 | Lahaye et al. | 432/179 |
| 4,148,600 | 4/1979 | Croft et al. | 432/59 |
| 4,183,306 | 1/1980 | Haga et al. | 110/204 |
| 4,191,525 | 3/1980 | Sallman | 432/199 |
| 4,196,892 | 4/1980 | Pike | 266/147 |
| 4,315,619 | 2/1982 | Inoue et al. | 266/89 |
| 4,460,398 | 7/1984 | Sasaki | 65/327 |
| 4,483,256 | 11/1984 | Brashear | 110/210 |
| 4,629,413 | 12/1986 | Michelson et al. | 431/9 |
| 4,690,387 | 9/1987 | Rockenschaub et al. | 266/144 |
| 4,754,952 | 7/1988 | Hattori et al. | 266/80 |
| 4,780,137 | 10/1988 | Rockenschaub et al. | 75/59.1 |
| 5,135,387 | 8/1992 | Martin et al. | 431/116 |
| 5,235,757 | 8/1993 | Josefsson et al. | 34/18 |
| 5,316,469 | 5/1994 | Martin et al. | 431/116 |
| 5,324,486 | 6/1994 | Russo | 422/207 |
| 5,347,103 | 9/1994 | Lemieux | 219/400 |

*Primary Examiner*—Harold Joyce
*Assistant Examiner*—Gregory A. Wilson
*Attorney, Agent, or Firm*—Weingarten, Schurgin, Gagnebin & Hayes LLP

[57] ABSTRACT

A furnace for thermally processing product includes one or more eductors. The eductor provides for increased circulation of atmosphere within the furnace for heat transfer or outgassing purposes. The eductor may be used to introduce clean gas to a product which outgasses volatiles to enhance the outgassing process by lowering the partial pressure of the volatile across the product as it is being heated. The eductor is also used to enhance heating or cooling of a product. Additionally, the eductor may be used to reduce or eliminate air stagnation areas within the furnace. The eductor may be located entirely within the furnace to recirculate the atmosphere of the furnace. Alternatively, the eductor may be located outside the furnace housing such that the eductor entrains gas from ports attached to the furnace and then reintroduces the gas into the furnace after the gas is cleaned, heated or cooled.

21 Claims, 4 Drawing Sheets

FURNACE CHAMBER HAVING EDUCTOR TO ENHANCE THERMAL PROCESSING

FIELD OF THE INVENTION

The present invention relates generally to non-convection furnaces and more particularly to the circulation of atmosphere within a normal furnace.

BACKGROUND OF THE INVENTION

The thermal processing of product within a furnace, such as co-firing ceramics or any process where binders must be removed, requires the use of heat in order to bring the temperature of the product up to a predetermined temperature level. During thermal processing of a product, the product may outgas volatiles which may form a cloud of outgassing material about the product as it is being thermally processed. The formation of this cloud stalls the outgassing and therefore the thermal processing, increasing the processing time of the product.

Furnaces may have areas within them that have little or no air flow, resulting in air stagnation. These air stagnation areas may not have the same temperature as the rest of the atmosphere within the furnace, resulting in non-uniform temperatures across the furnace and therefore the product.

Eductors are devices which furnish a large amount of gas circulation. An eductor comprises a tubular section, open at each end, that has a high pressure nozzle disposed along a common longitudinal axis within one end of the tubular section. The nozzle is in communication with a gas source, and injects gas at high pressure into a first end of the tubular section. As the high velocity injected gas travels down the length of the tubular section, a high negative pressure is produced in the annular region behind the nozzle of the injected gas, which entrains gas at the first end of the tubular section. The entrained gas and injected high pressure gas mix within the tubular section and exit out the second end of the tubular section, thereby providing a relatively large amount of gasflow exiting the eductor.

SUMMARY OF THE INVENTION

A furnace including one or more eductors is disclosed. The eductors are used to provide or supplement the circulation of the atmosphere within the furnace. In certain applications, where the product being processed is releasing volatiles into the furnace atmosphere, the eductors are providing clean gas to the product, thereby enhancing the outgassing process. The eductors in this case are used in the furnace chamber to lower partial pressures of the outgassed volatiles across the product being thermally processed, thereby enhancing the thermal processing. Additionally, eductors may be disposed within the furnace to eliminate any stagnation areas within the furnace, thereby providing for a more uniform temperature environment throughout the furnace.

BRIEF DESCRIPTION OF THE DRAWINGS

The invention will be more fully understood from the following detailed description taken in conjunction with the accompanying drawings in which.

DESCRIPTION OF THE PREFERRED EMBODIMENT

Figure 1:
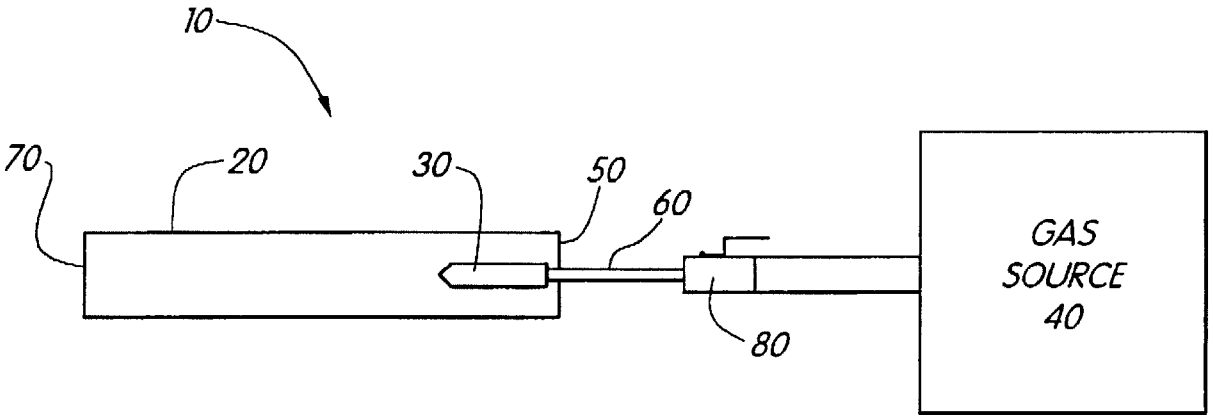
FIG. 1 is a cross-sectional diagram of a prior art eductor.

FIG. 1 shows a prior art eductor 10 comprising a tubular section 20 having a nozzle 30 disposed within a first or input end 50 of tubular section 20. The nozzle 30 is in communication with a compressed gas source 40. The compressed gas source 40 may comprise a gas tank or a compressor. The nozzle 30 receives compressed gas from compressed gas source 40 via conduit 60. Adjustment valve 80 is optional, and provides for additional control of the amount of compressed gas supplied to nozzle 30. Nozzle 30 provides for a high pressure injection of gas into the first end 50 of the tubular section 20. As a result of the injected high pressure gas traveling down the inside of the tubular section 20, a region having a pressure less than atmospheric pressure is produced in the annular region 50 behind the nozzle 30. Gas at the annular region 50 of the tubular section 20 is thus pushed in by atmospheric pressure into the tubular section 20 and travels down the inside of the tubular section 20. As a result, the gas exiting the second end 70 of tubular section 20 comprises a mixture of the injected high pressure gas and a large volume of the entrained gas. Ratios of the volume of entrained gas with respect to the volume of injected gas of up to 50:1 can be achieved. Eductors are relatively simple to fabricate, and offer high gas circulation at a relatively low cost. The eductors preferably have an aspect ratio of 10:1 between the length of the tubular section and the diameter of the tubular section to achieve the desired performance.

Figure 2:
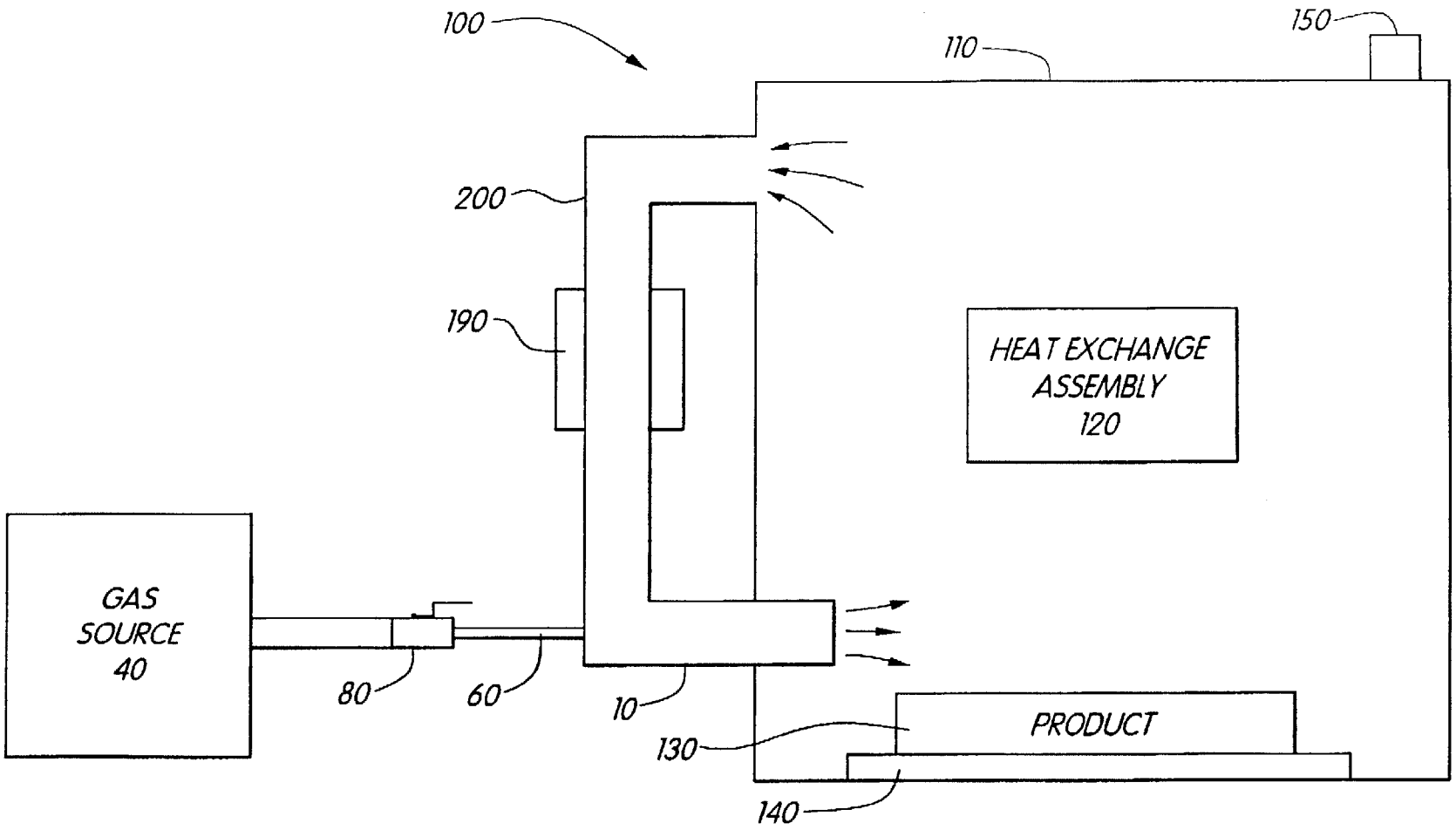
FIG. 2 is a cross-sectional diagram of a furnace including an eductor providing recirculated gas to the furnace.

Referring now to FIG. 2, a furnace 100 includes a furnace housing 110 which has a vent 150 provided to exhaust the furnace atmosphere outside the furnace housing 110. The product 130 to be thermally processed is placed into the furnace via a furnace opening (not shown). Such placement can be by means external to the furnace or can be manual. After the thermal processing has taken place, the product 130 is removed from the furnace either through the furnace opening or via a separate outlet (not shown). A heat exchange assembly 120 is disposed within the furnace housing 110 and provides heated gas or cool gas to a product 130 being thermally processed.

One or more eductors 10 is mounted in associated recirculation conduit 200 outside the furnace housing 110. The openings for the conduit 60 are sealed about the recirculation conduit 200 in any suitable manner as would be known in the art. The eductor 10 is positioned with its first or input end 50 outside the furnace and within the recirculation conduit 200 to bring recirculated gas into the furnace. The eductor 10 receives a supply of high pressure gas (the driving gas) from gas source 40 via conduit 60. For thermal processing applications, the gas may comprise air, steam, $N_2$ or any compressed gas. Conduit 60 optionally includes a control valve 80 to control the amount of gas supplied to eductor 10. A range of pressures from 5 pounds per square inch (psi) to 50 psi may be used, with the preferred pressure at approximately 35 psi.

As the injected gas travels down the inside of eductor 10, a pressure less than ambient to the furnace cavity area is created in the annular region behind the nozzle, thereby pulling a large amount of outside air into eductor 10. As a result, a large volume of gas exits eductor 10 and is directed across a product 130. For simplicity, only a single eductor 10 is shown for recirculated gas, although any number of eductors in any configuration and orientation could be used. Also shown is recirculated gas element 190. Recirculated gas element 190 may comprise a heater for heating recirculated gas as it passes through recirculation conduit 200, a cooler for cooling of the recirculated gas as it travels through recirculation conduit 200 or a cleaner for cleaning of the recirculated gas as it travels through recirculation conduit 200.

In addition, by providing a large volume of clean recirculated atmosphere into the furnace 100 the partial pressure of the unwanted material local to the product 130 is lowered. As a result, fresh gas replaces the existing gas which contains the volatiles resulting from the thermal processing of the product 130. As such, the speed and uniformity of the thermal processing of product which outgasses volatiles during thermal processing is enhanced.

Figure 3:
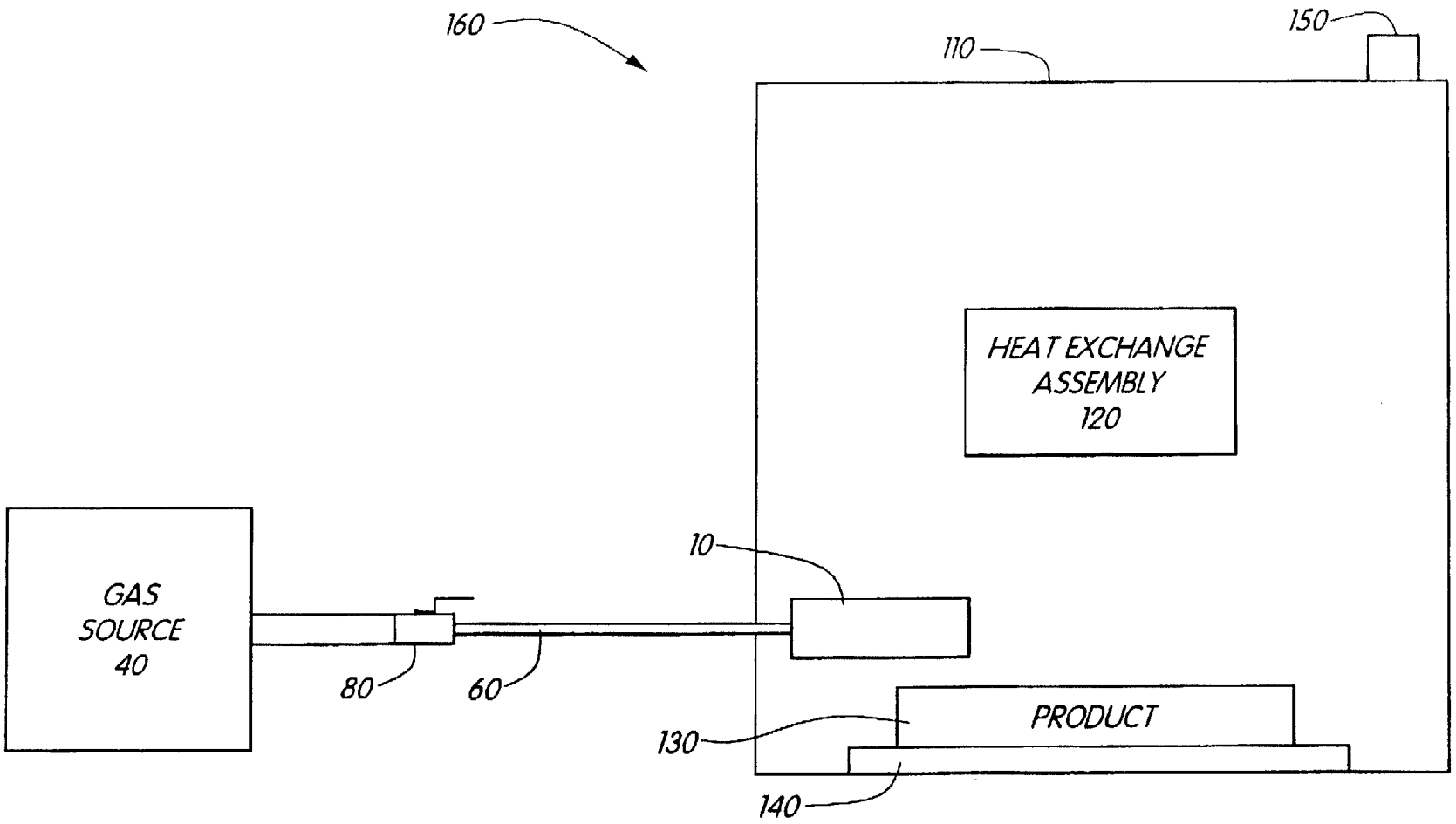
FIG. 3 is a cross-sectional diagram of a furnace including an eductor providing atmosphere flow across a product.

Referring now to FIG. 3, an eductor 10 is shown positioned entirely within the furnace 160 so that gas inside the furnace is entrained into the driving gas. The eductor 10 is in communication with gas source 40 via conduit 60, which may include a control valve 80 for adjustment of the gas entering the eductor 10. Eductor 10 is oriented such that it may direct gas flow across a surface of a product 130 being processed. As discussed above, the flow of the gas exiting the eductor 10 creates a lowering of a partial pressure across product 130, thereby enhancing the thermal processing of product 130.

Figure 4:
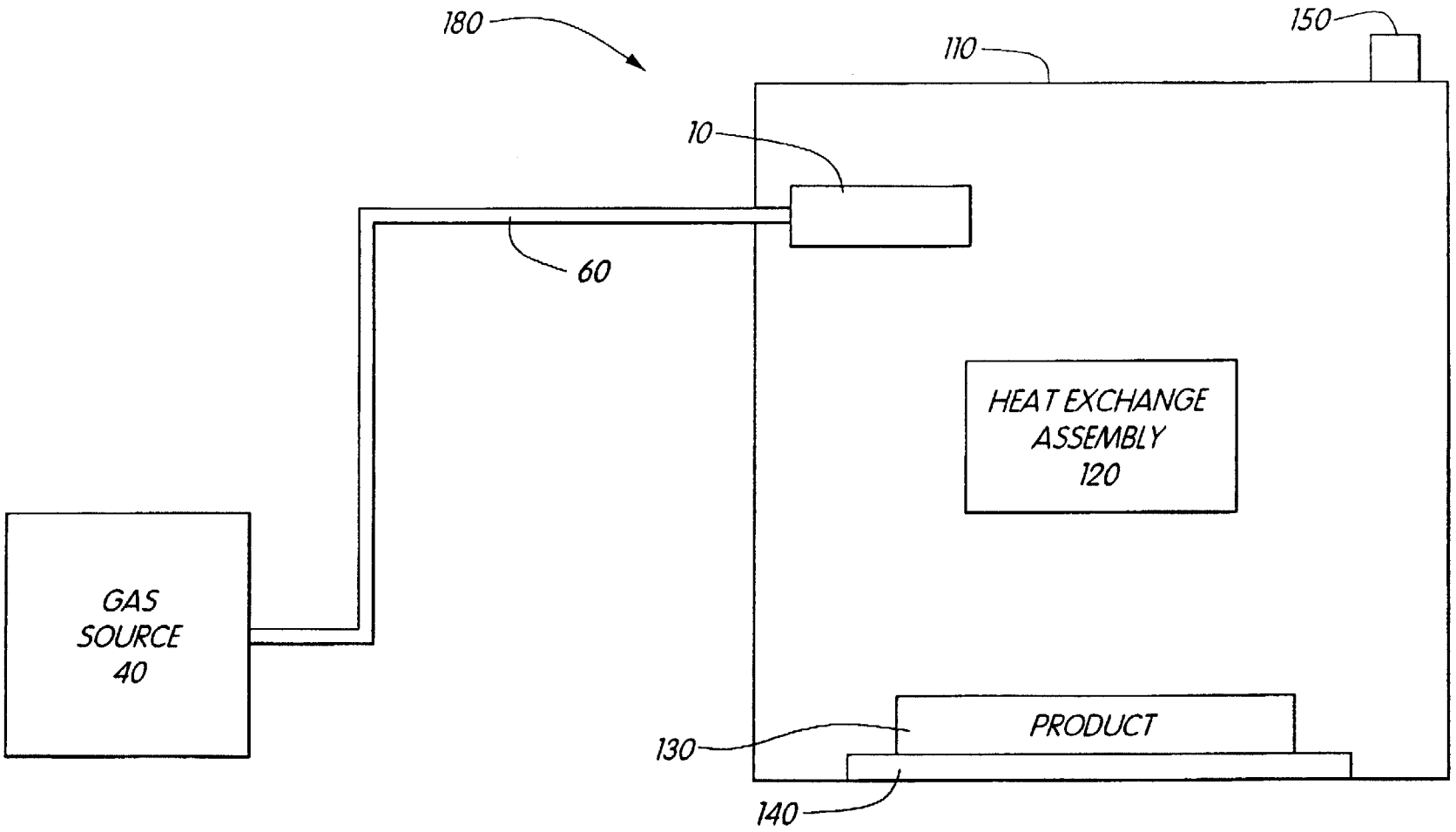
FIG. 4 is a cross-sectional diagram of a convection furnace including an eductor positioned to eliminate an air stagnation area within the furnace.

Referring now to FIG. 4, an eductor 10 is shown disposed entirely within furnace 180, oriented to direct air flow across the top of the furnace housing 110. Eductor 10 is also in communication with gas source 40 via conduit 60. In this instance, eductor 10 provides turbulence and motion of the furnace atmosphere within any given region of the furnace 180, thereby reducing or eliminating gas stagnation areas within the furnace. With the gas stagnation areas eliminated, a more uniform temperature across the interior of the furnace 180 is provided, thereby providing a more uniform furnace performance. One or more eductors may be located in any areas of the furnace where reduction or elimination of stagnation areas is desired.

By providing additional circulation within the furnace housing without the use of fans blowers, improved heating, cooling and thermal processing results. The eductors require less room than blowers or fans and, since the eductors have no moving parts, maintenance is minimal. Eductors are also more effective than fans or blowers at high operating temperatures and are much easier and less expensive to install and maintain.

Having described preferred embodiments of the invention it will now become apparent to those of ordinary skill in the art that other embodiments incorporating these concepts may be used. Accordingly, it is submitted that the invention should not be limited to the described embodiments but rather should be limited only by the spirit and scope of the appended claims.

I claim:

1. A furnace for thermally processing product comprising:

a furnace housing including a furnace inlet;

a support assembly disposed within said housing for supporting the product to be thermally processed;

a heat exchange assembly disposed within said furnace housing to change the temperature of the product; and an eductor comprising a tubular body having an annular inlet at one end and an outlet at the other end, a nozzle in communication with a pressurized gas source providing high velocity gas via a conduit, the nozzle located concentrically within the annular inlet of the tubular body, the nozzle disposed to direct the high velocity gas along the tubular body and entrain gas through the annular inlet into the high velocity gas, the outlet of said eductor located inside said furnace housing to provide circulation of gas within said furnace housing and disposed sufficiently adjacent to the product supported on said support assembly to direct gas flow across a surface of the product to lower a partial pressure of volatiles outgassing from the product.

2. The furnace of claim 1 further comprising a recirculation conduit having said eductor disposed therein.

3. The furnace of claim 1 wherein said heat exchange assembly provides heated gas to said product.

4. The furnace of claim 1 wherein said heat exchange assembly provides cool gas to said product.

5. The furnace of claim 1 wherein said annular inlet of said eductor is located outside of said furnace housing.

6. A furnace for thermally processing product comprising:

a furnace housing including a furnace inlet;

a support assembly disposed within said housing for supporting the product to be thermally processed;

a heat exchange assembly disposed within said furnace housing to change the temperature of the product; and an eductor comprising a tubular body having an annular inlet at one end located outside of said furnace housing and an outlet at the other end, a nozzle in communication with a pressurized gas source providing high velocity gas via a conduit, the nozzle located concentrically within the annular inlet of the tubular body, the nozzle disposed to direct the high velocity gas along the tubular body and entrain gas through the annular inlet into the high velocity gas, the outlet of said eductor located inside said furnace housing to provide circulation of gas within said furnace housing, wherein said outlet of said eductor is disposed to lower a partial pressure across the product.

7. A furnace for thermally processing product comprising:

a furnace housing including a furnace inlet;

a support assembly disposed within said housing for supporting the product to be thermally processed;

a heat exchange assembly disposed within said furnace housing to change the temperature of the product; and an eductor comprising a tubular body having an annular inlet at one end located outside of said furnace housing and an outlet at the other end, a nozzle in communication with a pressurized gas source providing high velocity gas via a conduit, the nozzle located concentrically within the annular inlet of the tubular body, the nozzle disposed to direct the high velocity gas along the tubular body and entrain gas through the annular inlet into the high velocity gas, the outlet of said eductor located inside said furnace housing to provide circulation of gas within said furnace housing, wherein said outlet of said eductor is disposed to displace volatiles outgassing from the product.

8. The furnace of claim 1 wherein said annular inlet of said eductor is located inside of said furnace housing.

9. A furnace for thermally processing product comprising:

a furnace housing including a furnace inlet;

a support assembly disposed within said housing for supporting the product to be thermally processed;

a heat exchange assembly disposed within said furnace housing to change the temperature of the product; and an eductor comprising a tubular body having an annular inlet at one end and an outlet at the other end, a nozzle in communication with a pressurized gas source providing high velocity gas via a conduit, the nozzle located concentrically within the annular inlet of the tubular body, the nozzle disposed to direct the high velocity gas along the tubular body and entrain gas through the annular inlet into the high velocity gas, the outlet of said eductor located inside said furnace housing to provide circulation of gas within said furnace housing, wherein said outlet of said eductor is disposed to direct gas across a top of the furnace housing to an area of stagnating gas within the furnace housing.

10. The furnace of claim 9 wherein said inlet of said eductor is located inside the furnace housing.

11. The furnace of claim 9 wherein said inlet of said eductor is located outside the furnace housing.

12. The furnace of claim 2 wherein said recirculation conduit further comprises a recirculation gas element disposed within said recirculation conduit.

13. The furnace of claim 12 wherein said recirculation gas element comprises a heater.

14. A furnace for thermally processing product comprising:

a furnace housing including a furnace inlet;

a support assembly disposed within said housing for supporting the product to be thermally processed;

a heat exchange assembly disposed within said furnace housing to change the temperature of the product; and an eductor comprising a tubular body having an annular inlet at one end and an outlet at the other end, a nozzle in communication with a pressurized gas source providing high velocity gas via a conduit, the nozzle located concentrically within the annular inlet of the tubular body, the nozzle disposed to direct the high velocity gas along the tubular body and entrain gas through the annular inlet into the high velocity gas, the outlet of said eductor located inside said furnace housing to provide circulation of gas within said furnace housing;

a recirculation conduit disposed for recirculating gas within said furnace housing, said eductor disposed within said recirculation conduit;

a cooler disposed within said recirculation conduit to cool gas therein.

15. A furnace for thermally processing product comprising:

a furnace housing including a furnace inlet;

a support assembly disposed within said housing for supporting the product to be thermally processed;

a heat exchange assembly disposed within said furnace housing to change the temperature of the product; and an eductor comprising a tubular body having an annular inlet at one end and an outlet at the other end, a nozzle in communication with a pressurized gas source providing high velocity gas via a conduit, the nozzle located concentrically within the annular inlet of the tubular body, the nozzle disposed to direct the high velocity gas along the tubular body and entrain gas through the annular inlet into the high velocity gas, the outlet of said eductor located inside said furnace housing to provide circulation of gas within said furnace housing;

a recirculation conduit disposed for recirculating gas within said furnace housing, said eductor disposed within said recirculation conduit;

a cleaner disposed within said recirculation conduit to clean gas therein.

16. The furnace of claim 1 further comprising:

an outlet in said furnace housing; and a transport assembly disposed within said furnace housing, from said furnace inlet to said furnace outlet.

17. The furnace of claim 1 wherein the gas circulated by said eductor comprises air.

18. The furnace of claim 1 wherein the gas circulated by said eductor comprises $N_2$.

19. The furnace of claim 1 wherein the gas circulated by said eductor comprises steam.

20. A furnace for thermally processing product comprising:

a furnace housing including a furnace inlet:

a support assembly disposed within said housing for supporting the product to be thermally processed;

a heat exchange assembly disposed within said furnace housing to change the temperature of the product; and an eductor comprising a tubular body having an annular inlet at one end and an outlet at the other end, a nozzle in communication with a pressurized gas source providing high velocity gas via a conduit, the nozzle located concentrically within the annular inlet of the tubular body, the nozzle disposed to direct the high velocity gas along the tubular body and entrain gas through the annular inlet into the high velocity gas, the outlet of said eductor located inside said furnace housing to provide circulation of gas within said furnace housing, wherein said eductor has an aspect ratio of approximately 10:1 between the length of the tubular body and the diameter of the tubular body.

21. A furnace for thermally processing product comprising:

a furnace housing including a furnace inlet and a furnace outlet;

a support assembly disposed within said housing for supporting the product to be thermally processed;

a transport assembly disposed within said furnace housing to transport the product from said furnace inlet to said furnace outlet;

a heat exchange assembly disposed within said furnace housing to change the temperature of the product; and an eductor comprising a tubular body having an annular inlet at one end and an outlet at the other end, a nozzle in communication with a pressurized gas source providing high velocity gas via a conduit, the nozzle located concentrically within the annular inlet of the tubular body, the nozzle disposed to direct the high velocity gas along the tubular body and entrain gas through the annular inlet into the high velocity gas, the outlet of said eductor located inside said furnace housing to provide circulation of gas within said furnace housing.

* * * * *